US006752437B1

(12) United States Patent
Bantle et al.

(10) Patent No.: US 6,752,437 B1
(45) **Date of Patent: *Jun. 22, 2004**

(54) FASTENING MECHANISM FOR A COVER, DOOR OR THE LIKE

(75) Inventors: Ulrich Bantle, Empfingen (DE); Walter Köster, Ganderkesee (DE)

(73) Assignee: Karl Simon GmbH & Co. KG, Aichhalden (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/527,707

(22) Filed: Mar. 17, 2000

(30) Foreign Application Priority Data

Mar. 17, 1999 (DE) ..... 199 11 793

(51) Int. Cl.[7] ..... E05C 3/16
(52) U.S. Cl. ..... 292/227; 292/56; 292/53
(58) Field of Search ..... 312/348.6, 322, 312/323; 16/444, 446, 412; 292/221, 227, 53, 56, 336.3

(56) References Cited

U.S. PATENT DOCUMENTS 307,281 A * 10/1884 Farrar
451,526 A * 5/1891 Sandberg
560,888 A * 5/1896 Ayars ..... 292/221 X
2,010,492 A * 8/1935 Karre
2,217,098 A * 10/1940 Brownne
2,321,724 A * 6/1943 Aldeen et al.
4,156,794 A * 5/1979 Robinson ..... 174/16 R
5,975,597 A * 11/1999 Makiuchi et al. ..... 292/336.3

* cited by examiner

*Primary Examiner*—Teri Pham Luu
(74) *Attorney, Agent, or Firm*—Pauley Petersen Kinne & Erickson

(57) ABSTRACT

A fastening mechanism for a cover, door or the like, hinged on a body, frame or the like, wherein a locking element is fixedly attached to the body, frame or the like. The cover, door or the like supports an actuating element which controls a locking mechanism that can be disengaged from the locking element during opening and engaged with the locking element during closing. To assure an easy operation of such a fastening mechanism, while at the same time assuring locking, the actuating element can be moved from the closed position to the open position by a pulling force acting generally perpendicularly relative to the connecting plane defined by the cover, door or the like.

19 Claims, 4 Drawing Sheets

FASTENING MECHANISM FOR A COVER, DOOR OR THE LIKE

FIELD OF THE INVENTION

This invention relates to a fastening mechanism for a cover, door or the like, hinged on a body, frame or the like, wherein a locking element is fixedly attached to the body, frame or the like, the cover, door or the like supports an actuating element, the actuating element controls a locking mechanism which can be disengaged from the locking element during opening and engaged with the locking element during closing.

BACKGROUND OF THE INVENTION

A fastening mechanism is desired for furniture, in particular, which is easy to operate and yet results in a definite securing of the closed position. This is of special importance for overhead cabinets in house trailers and mobile homes and the like, since their fastening mechanisms are often only accessible at the level of the head of the user.

Various so-called rotatable fastening mechanisms are known, wherein an actuating element must be rotated for opening, and thereafter the cover, door and the like must be pulled into the opening position. Opening of the cover, door or the like is more difficult with the operating step, which can be performed in two directions, in particular in those cases where the fastening mechanism is arranged at a height which is disadvantageous for the user.

Magnetic and snap fastening mechanisms are also known, which do not require a separate actuating element and which can be brought into an opening or closing position merely by the pivot movement of the cover, door or the like. Here, a compromise is made between the holding and the opening force of the cover, door or the like, which often leads to an insufficiently fixed locking position.

SUMMARY OF THE INVENTION

It is one object of this invention to provide a fastening mechanism of the type mentioned above but which is easy to operate and in particular results in an assured locking in the closed position.

In accordance with this invention this object is attained with the actuating element that is moved from the closed position to the open position by a pulling force acting essentially perpendicularly in relation to the connecting plane defined by the cover, door or the like.

With this fastening mechanism the lock between the cover or door and the body or frame is released when the user exerts a force on the actuating element, which acts generally perpendicular with respect to the door plane. Thus the movement required for unlocking also extends in the direction in which the cover or door is pivoted open. A harmonious and compulsory course of movement results when unlocking and opening the cover or door, which is considered to be pleasant and therefore results in a simple operation of the fastening mechanism.

In one preferred embodiment the actuating element is designed as a bow-shaped or U-shaped handle with two legs, which extend parallel to each other, and a handle element, wherein the two legs are adjustably fastened on the cover, door or the like. At least one of the legs passes through an opening in the cover or door and on the back of the cover or door is in an operative connection with the locking mechanism.

The handle has a pleasant appearance and can be simply manipulated for actuating the fastening mechanism.

To prevent tilting of the two legs of such a fastening mechanism with respect to the cover, door or the like, the two legs can control the locking mechanism. The second leg is connected to a mounting element on the back of the cover or door and is held adjustably there.

A simple mechanical structure for a fastening mechanism with a handle results if at least one of the legs is connected to a locking lever and/or a guide lever. The locking lever and/or the guide levers are seated on a mounting element and are pivotal around a hinge pin that extends parallel with a link pin of the cover, door or the like. The hinge pin is maintained at a distance away from the leg by the locking lever and/or the guide lever. The greater the distance of the leg is selected to be from the hinge pin, the closer the unlocking movement of the actuating element approaches a linear movement, so that a quasi perpendicular movement results.

For fastening the handle on the cover or door the free end of at least one of the legs of the actuating element is coupled with a connecting sleeve, which passes through the opening of the cover, door or the like and is connected on the back of the cover or door to a mounting element. A fastening screw is pushed through the connecting sleeve and is screwed into the leg connects the leg with the mounting element. The connecting sleeve can also be used for matching the different thickness of the cover or door for which connecting sleeves of different lengths are used.

In one preferred embodiment of this invention, the locking element is embodied as a locking bolt on the body, frame or the like. The actuating element is adjustable relative to the cover, door or the like and controls a locking mechanism on the inside thereof, which includes of a locking lever and a rotatably seated locking claw. The locking claw is held in a receiving position for the insertion of the locking bolt in the open position of the fastening mechanism. The locking claw extends behind the locking bolt in the closed position, and the locking lever, which is displaced by the actuating element and is spring-loaded, locks the locking claw in the closed position.

For opening the cover, door and the like it is only necessary to operate the actuating element in order to move the locking lever far enough so that it releases the lock with the locking claw. The locking bolt is released by the pivot movement of the cover, door and the like by rotating the locking claw, and the cover, door and the like can be opened without hindrance. The locking claw is pivoted so far that it assumes its receiving position and is held therein, so that when the cover, door and the like is closed, the locking bolt is again inserted into the locking claw. In the final closing movement of the cover, door and the like the locking claw is rotated into the locked position by the inserted locking bolt, so that the spring-loaded locking bolt can lock the locking claw. Thus, the cover, claw and the like is clearly secured in the locked position and can only be unlocked and opened by operating the actuating element.

In one embodiment, the operation of the fastening mechanism is further eased because the locking lever and/or the guide lever are supported by a compression spring on the inside of the cover, door and the like, and a locking projection can be moved into a pivot range and out of the pivot range of the locking claw, which has a locking shoulder.

In accordance with a further embodiment, the locking lever and the locking claw are rotatably seated on a mounting element attached to the inside of the cover, door and the like, wherein the hinge pins are aligned parallel with respect to each other and parallel with the link pin of the cover, door and the like. The locking mechanism can be attached as a unit on the inside of the cover, door and the like, and only needs to be connected with the actuating element.

Following the opening of the fastening mechanism, the locking claw can be maintained in the receiving position for the locking bolt. In the opening position of the fastening mechanism, the locking claw can be restored to and maintained in the receiving position for the locking bolt by a spring, which is guided in a guidance receiver of the locking lever.

The same result can also be achieved because in the receiving position the locking claw is snapped into a snap-in receiver of the mounting element by a snapin projection. During closing and releasing the fastening mechanism, the snapped-in connection can be achieved and released by rotating movement of the locking claw.

In accordance with a further embodiment, the locking mechanism is simplified because the locking lever and the mounting element are embodied as a one-piece plastic element and are hingedly connected with each other.

In accordance with another embodiment, the displacement movement of the actuating element is limited in both displacement directions by detents, wherein the compression spring displaces the locking lever in the direction of the closed position when the actuating element is released. A defined position of the locking lever and the locking claw is maintained during the opening and closing of the cover, door and the like.

BRIEF DESCRIPTION OF THE DRAWINGS

This invention is explained in greater detail by exemplary embodiments represented in the drawings, wherein.

DESCRIPTION OF PREFERRED EMBODIMENTS

This invention is explained by means of exemplary embodiments, wherein the fastening mechanism is used on a suspended hinged cover 10 of an overhead cabinet. In this case the lower edge area of the cover 10 and the body 20 of the overhead cabinet form the locked side with the fastening mechanism, which is located opposite the hinged side.

Figure 2:
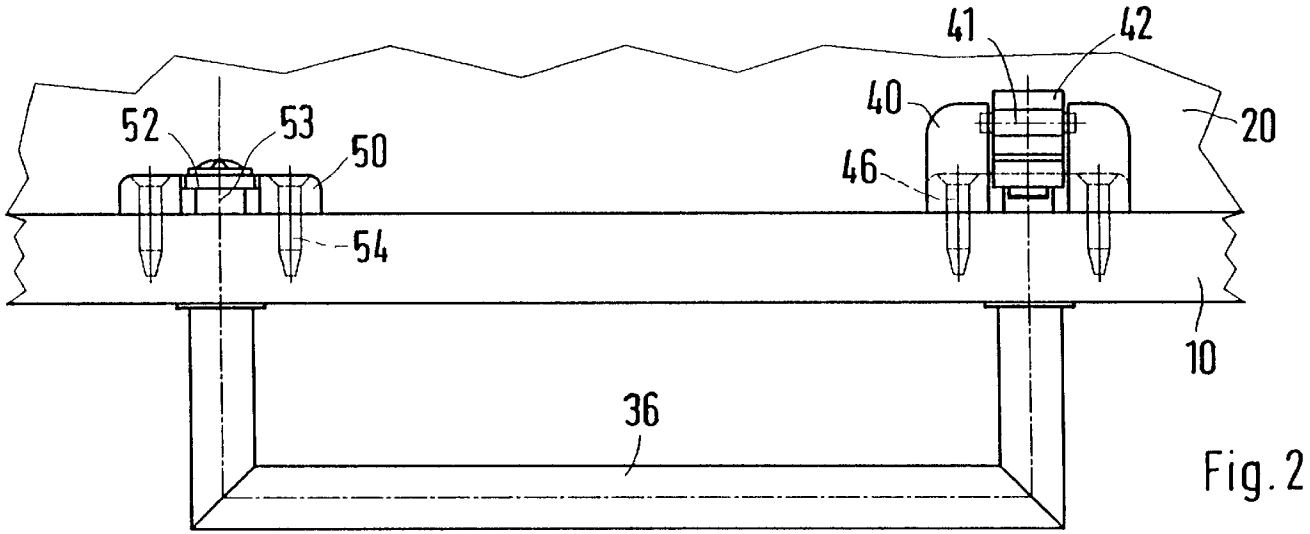
FIG. 2 is a top view of the fastening mechanism in FIG. 1.
Figure 3:
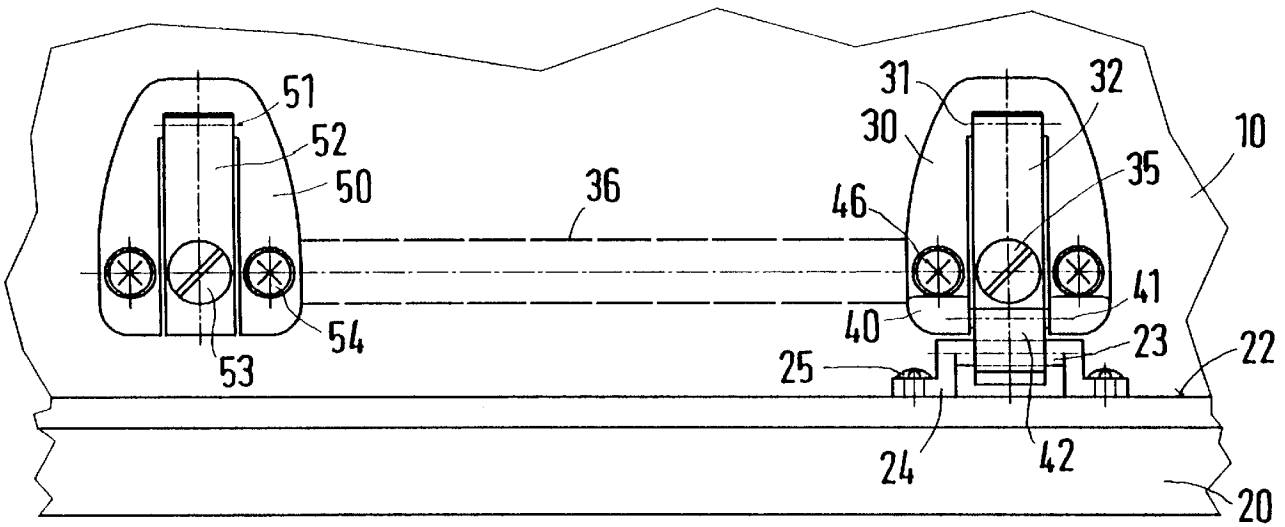
FIG. 3 is a plan view of the fastening mechanism in FIG. 1 in the direction of the inside of the cover.
Figure 6:
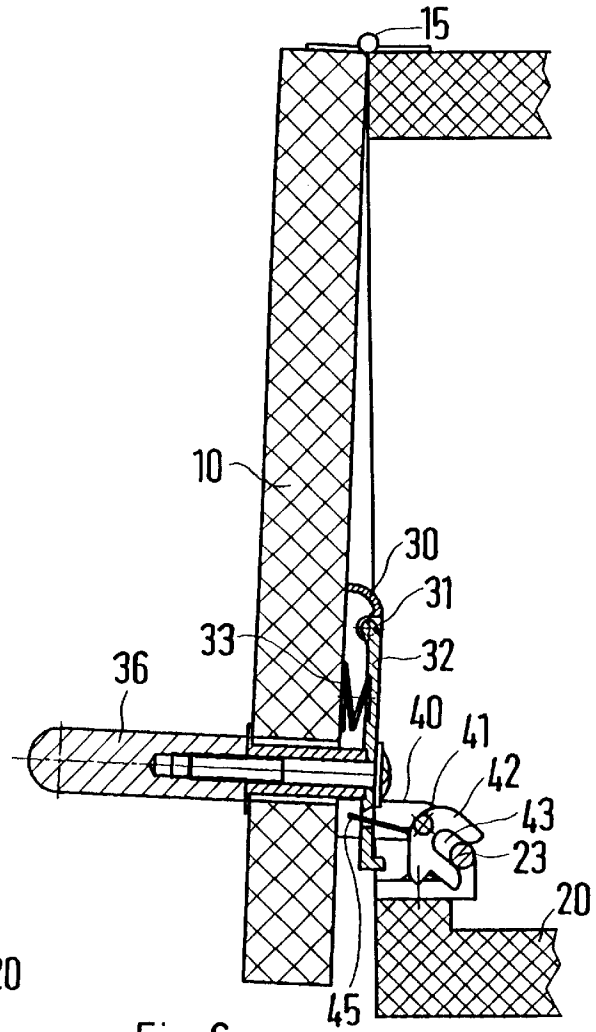
FIG. 6 is a sectional view of the return of the locking claw into the receiving position for the locking bolt.
Figure 5:
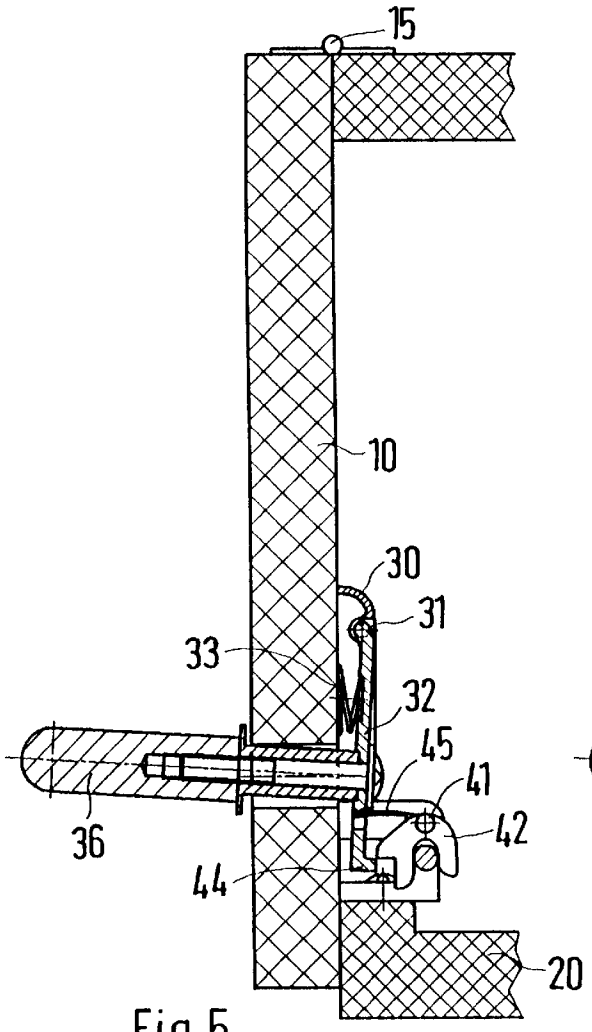
FIG. 5 is a sectional view of the unlocking of the locking claw at the start of the opening movement.
Figure 4:
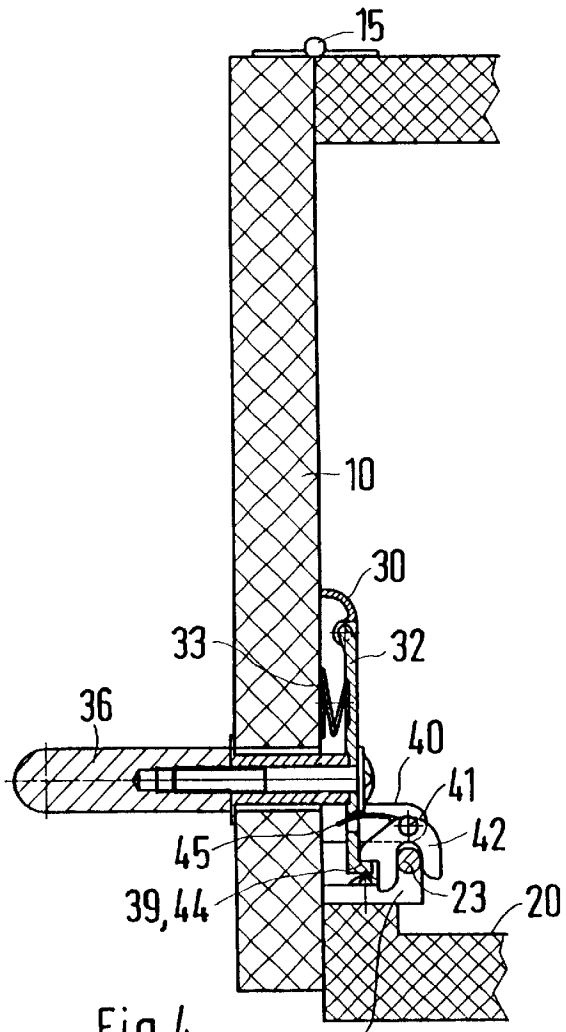
FIG. 4 is a sectional view of the fastening mechanism in FIG. 1 on a reduced scale on an overhead cabinet with a suspended cover in the closed position.

A mounting element 24, which supports the locking bolt 23 extending parallel with the link pin 15 of the cover 10, is fastened with fastening screws on the front side 22 in an edge area 21 of the cabinet opening, as shown in FIGS. 4 to 6. The cover 10 has openings 11, in which a U-shaped handle as the actuating element 36 is adjustably guided by its lateral legs, generally perpendicular with respect to the cover plane. In this case a lateral leg of the actuating element 36 has a threaded connection 37 with a fastening screw 35, which connects a locking lever 32 arranged on the inside of the cover 10, with the actuating element 36. As shown in FIGS. 2 and 3, the other lateral leg of the actuating element 36 is connected by a fastening screw 53 with a guide lever 52, which is hinged on a mounting element 50 fastened on the inside of the cover 10, as suggested by the link pin 51. The mounting element 50 is connected with the cover 10 by fastening screws 54. It is possible, as indicated in connection with the fastening screw 35, to use a connecting sleeve 34 which, together with the locking lever 32, or respectively the guide lever 52, limits the displacement movement in both directions.

Figure 1:
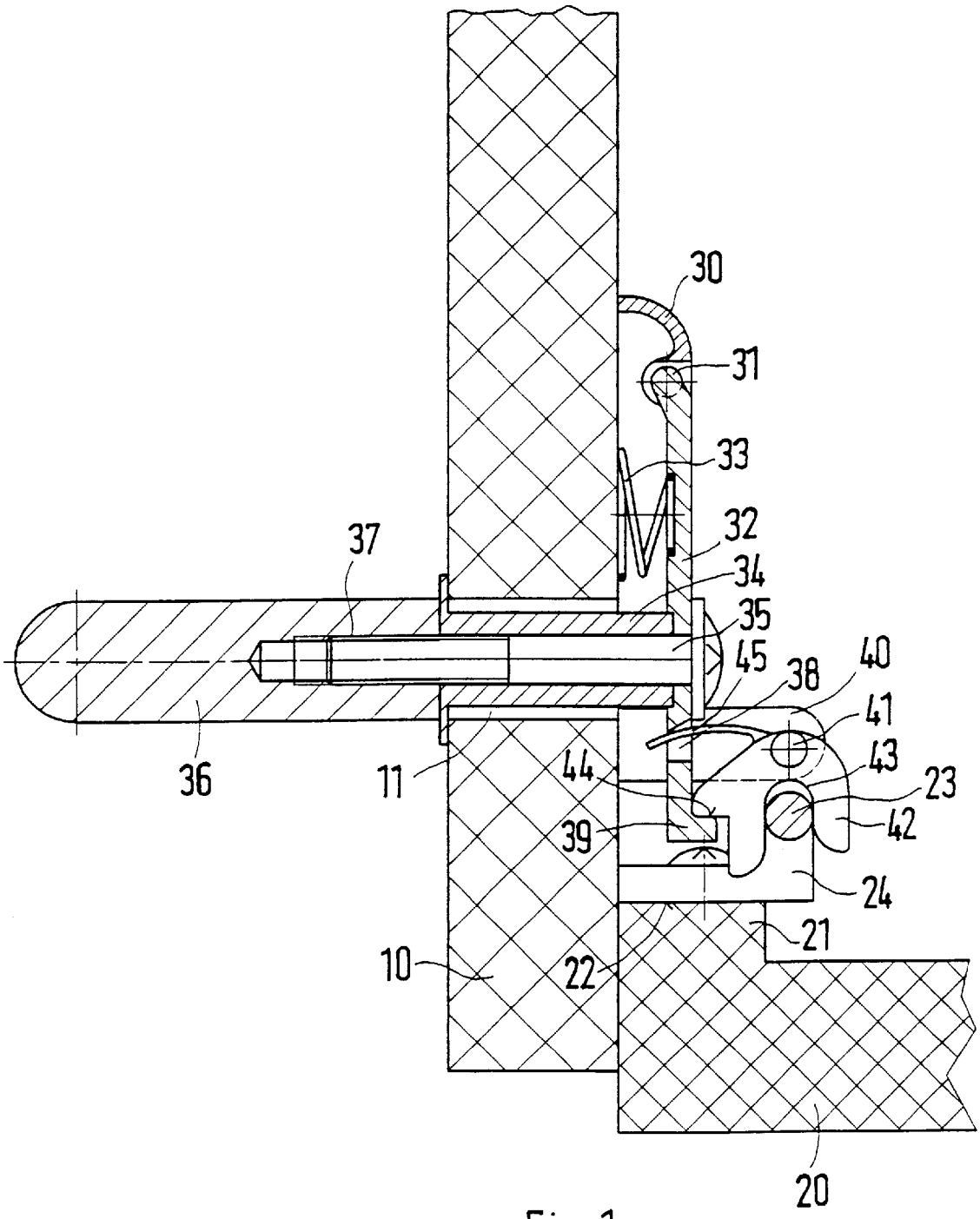
FIG. 1 is a sectional view of a first exemplary embodiment of a fastening mechanism in a locked position, wherein the locking claw is maintained in the receiving position for the locking bolt by means of a spring.

The locking lever 32 is hinged on a mounting element 30, as shown in FIGS. 1 and 2. The mounting element 30 is fastened on the cover 10 by means of fastening screws 46 and has bearing brackets 40, on which the locking claw 42 is pivotally seated by means of the hinged bolt 41. The same as the hinged bolt 31 of the locking lever 32, the hinged bolt 41 is aligned parallel with the link pin 15 of the cover 10.

The locking claw 42 has a claw receiver 43, into which the locking bolt 23 can be inserted. The locking lever 32 is resiliently supported on the cover 10 by means of a compression spring 33, so that with the cover 10 opened, the actuating element 36 is maintained in the inserted end position, which is associated with the closed and locked position.

The functioning of the fastening mechanism is explained in view of FIGS. 4 to 6, wherein FIG. 4 shows the closed position. The locking claw 42 is pushed on the locking bolt 23 and is pivoted to extend behind the locking bolt 23. The locking lever 32 is pivoted away from the cover 10 by the compression spring 33 so far that its locking projection 39 engages with the locking shoulder 44 of the locking claw 42 and assures locking. In place of the locking projection 39 it is also possible to provide a recess in the locking lever 32, which is engaged by the locking shoulder 44.

If a pull is exerted on the actuating element 36, the locking lever 32 with a locking projection 39 is moved out of the pivot range of the locking claw 42 against the force of the compression spring 33, as shown in FIG. 5. While opening the cover 10, the locking claw 42 is pivoted on the locking bolt 23, until it slides out of the claw receiver 43 and the locking claw 42 assumes its receiving position for the locking bolt 23, as clearly shown in FIG. 6.

If the cover 10 is closed further, the locking claw 42 is again conducted on the locking bolt 23 and rotated into the closing position wherein, after release of the actuating element 36, the compression spring 33 assures the locking of the fastening mechanism.

The locking claw 42 is guided by means of a spring 45 in a guidance receiver 38 of the locking lever 32 in such a way that in the open position of the fastening device the locking claw 42 is maintained in the receiving position for introducing the locking bolt 23. The precise progress of the closing and locking process is thus assured.

Figure 7:
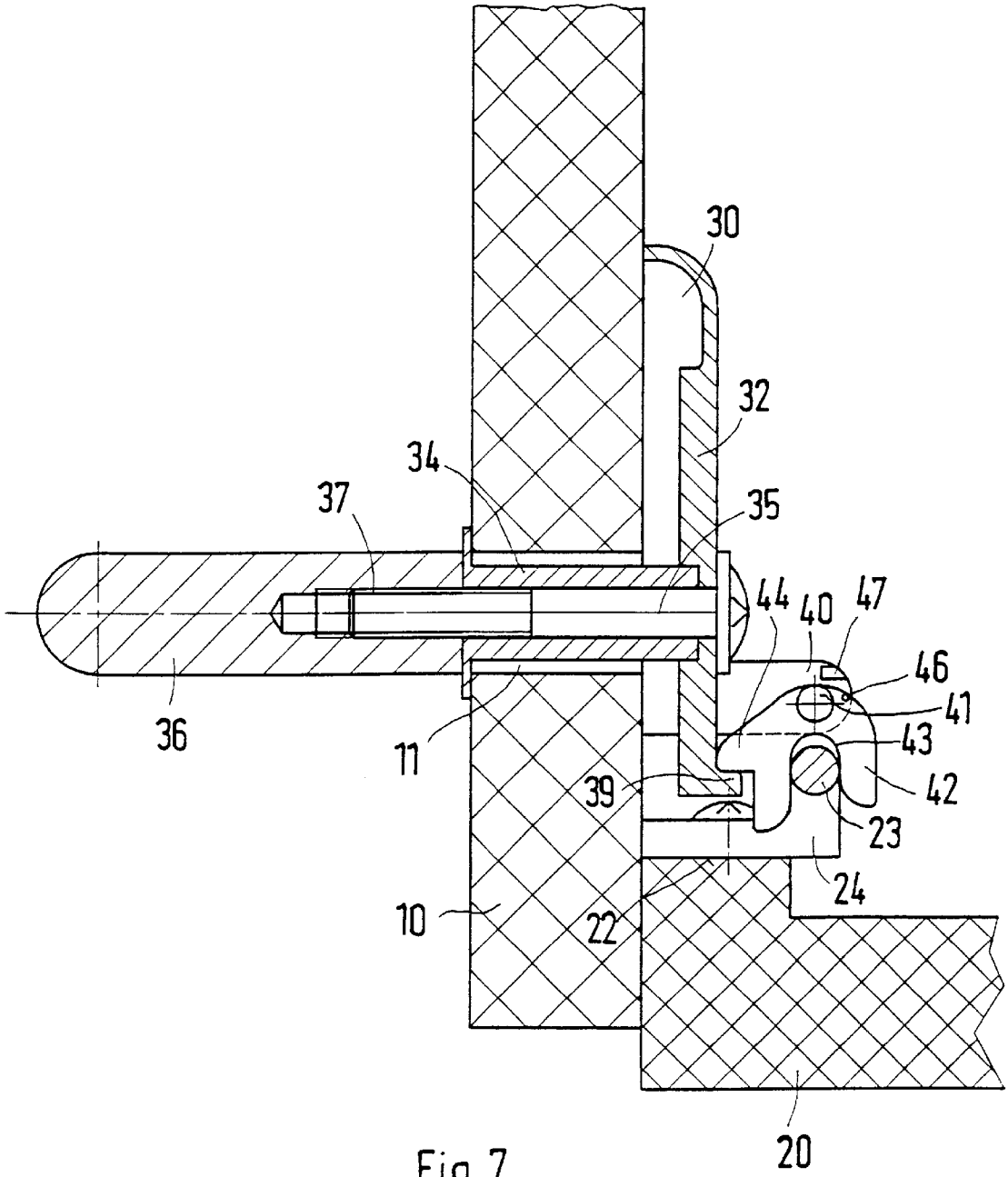
FIG. 7 is sectional view of a second exemplary embodiment of a fastening mechanism, wherein the locking claw is maintained in the receiving position for the locking bolt by an additional snap-in connection.

As shown by the exemplary embodiment in FIG. 7, the locking lever 32 can be one piece with the mounting element 30 in the form of a plastic part, wherein a spring section can form the hinge pin 31. The spring section assures the locking of the fastening mechanism. Moreover, the securing of the locking claw 42 in the reception position for the locking bolt 23 can be achieved by means of an additional snap-in connection, which includes a snap-in projection 46 and a snap-in receiver 47. In the open position of the fastening mechanism the snap-in projection 46 of the locking claw 42 is snapped into the snap-in receiver 47 of the mounting element 30 in the area of the bearing brackets 40. It is also possible that the snap-in projection 46 is frictionally held in the snap-in receiver 47. If when closing the cover 10 the locking bolt 23 is inserted into the claw receiver 43, in the end phase of the closing movement of the cover 10 the locking claw 42 is rotated by the locking bolt 23 and the snap-in connection is released. In its end position, the locking lever 32 can lock the locking claw 42. While opening the cover 10, the lock between the locking lever 32 and the locking claw 42 is released, the locking claw is rotated back into the receiving position, during which the snap-in connection between the locking claw 42 and the mounting element 30 is restored.

The actuating element 36 can also merely be designed as a furniture knob and can be connected only with the locking lever 32.

What is claimed is:

1. In a fastening mechanism for a cover hinged on a body wherein a locking element is fixedly attached to the body, the cover supports an actuating element, and the actuating element controls a locking mechanism which can be disengaged from the locking element during opening and engaged with the locking element during closing, the improvement comprising:

the actuating element (36) moveable from a closed position to an open position by a pulling force acting generally perpendicular with respect to a connecting plane defined by the cover (10), a free end of at least one leg of the actuating element (36) coupled with a connecting sleeve (34) passing through the opening (11) of the cover (10) and connected on a back of the cover (10) to a mounting element (30, 50), and a fastening screw (35) passing through the connecting sleeve (34) and screwed into and connecting the at least one leg with the mounting element (30, 50).

2. In the fastening mechanism in accordance with claim 1, wherein the actuating element (36) is designed as one of a bow-shaped handle and a U-shaped handle with two legs extending parallel to each other and a handle element, the two legs are adjustably fastened on the cover (10), and at least one of the legs passes through an opening (11) in the cover (10) and on a back of the cover (10) is in an operative connection with the locking mechanism.

3. In the fastening mechanism in accordance with claim 1, wherein a first leg of the at least one leg controls the locking mechanism, and a second leg of the at least one leg is adjustably connected to a mounting element (50) on the back of the cover (10).

4. In the fastening mechanism in accordance with claim 1, wherein the at least one leg is connected to at least one of a locking lever (32) and a guide lever (52), at least one of the locking lever (32) and the guide lever (52) is seated on the mounting element (30, 50) and pivots around a hinge pin (31), the hinge pin (31) extends parallel with the link pin of the cover (10), and the hinge pin (31) is maintained at a distance away from the at least one leg by at least one of the locking lever (32) and the guide lever (52).

5. In the fastening mechanism in accordance with claim 4, wherein at least one of the locking lever (32) and the guide lever (52) is supported by a compression spring (33) on the inside of the cover (10), and a locking projection (44) is moved into a pivot range and out of the pivot range of the locking claw (42) which has a locking shoulder (39).

6. In the fastening mechanism in accordance with claim 1, the locking element (23) is formed as a locking bolt on the body (20), the actuating element (36) is adjustable with respect to the cover (10) and controls a locking mechanism on an inside which has a locking lever (32) and a rotatably seated locking claw (42), the locking claw (42) is held in a receiving position for insertion of the locking bolt (23) in the open position of the fastening mechanism, the locking claw (42) extends behind the locking element (23) in the closed position, and the locking lever (32) is displaced by the actuating element (36) and is spring-loaded and locks the locking claw (32) in the closed position.

7. In a fastening mechanism for a cover hinged on a body wherein a locking element is fixedly attached to the body, the cover supports an actuating element, and the actuating element controls a locking mechanism which can be disengaged from the locking element during opening and engaged with the locking element during closing, the improvement comprising:

the actuating element (36) moveable from a closed position to an open position by a pulling force acting generally perpendicular with respect to a connecting plane defined by the cover (10);

the actuating element (36) designed as one of a bow-shaped handle and a U-shaped handle with two legs and a handle element, the two legs adjustably fastened on the cover (10), and at least one of the legs passing through an opening (11) in the cover (10) and on a back of the cover (10) being in an operative connection with the locking mechanism;

a first leg of the legs controlling the locking mechanism, and a second leg of the legs adjustably connected to a mounting element (50) on the back of the cover (10);

at least one of the legs connected to at least one of a locking lever (32) and a guide lever (52), at least one of the locking lever (32) and the guide lever (52) seated on the mounting element (30, 50) and pivotable around a hinge pin (31), the hinge pin (31) extending parallel with the link pin of the cover (10), the hinge pin (31) maintained at a distance away from the at least one of the legs by at least one of the locking lever (32) and the guide lever (52); and a free end of at least one of the legs of the actuating element (36) coupled with a connecting sleeve (34) passing through the opening (11) of the cover (10) and connected on the back of the cover (10) to the mounting element (30, 50), and a fastening screw (35) passing through the connecting sleeve (34) and screwed into and connecting the at least one of the legs with the mounting element (30, 50).

8. In the fastening mechanism in accordance with claim 7, wherein the locking element (23) is formed as a locking bolt on the body (20), the actuating element (36) is adjustable with respect to the cover (10) and controls a locking mechanism on an inside which has a locking lever (32) and a rotatably seated locking claw (42), the locking claw (42) is held in a receiving position for insertion of the locking bolt (23) in the open position of the fastening mechanism, the locking claw (42) extends behind the locking element (23) in the closed position, and the locking lever (32) is displaced by the actuating element (36) and is spring-loaded and locks the locking claw (32) in the closed position.

9. In the fastening mechanism in accordance with claim 8, wherein at least one of the locking lever (32) and the guide lever (52) is supported by a compression spring (33) on the inside of the cover (10), and a locking projection (44) is moved into a pivot range and out of the pivot range of the locking claw (42) which has a locking shoulder (39).

10. In the fastening mechanism in accordance with claim 9, wherein the locking lever (32) and the locking claw (42) are rotatably seated on a mounting element (30) attached to the inside of the cover (10), and the hinge pins (31,41) are aligned parallel with respect to each other and the link pin (15) of the cover (10).

11. In the fastening mechanism in accordance with claim 10, wherein in the open position of the fastening mechanism the locking claw (42) is restored to and maintained in the receiving position for the locking bolt (23).

12. In the fastening mechanism in accordance with claim 11, wherein the locking lever (32) and the mounting element (30) are embodied as a one-piece plastic element.

13. In the fastening mechanism in accordance with claim 12, wherein in the receiving position the locking claw (42) is snapped into a snap-in receiver (46) of the mounting element (30) by a snap-in projection (46), and while closing and releasing the fastening mechanism the snapped-in connection is achieved and released by rotating the locking claw(42).

14. In the fastening mechanism in accordance with claim 13, wherein the displacement movement of the actuating element (36) is limited in two displacement directions by detents, and the compression spring (33) displaces the locking lever (32) in a direction of the closed position when the actuating element (36) is released.

15. In the fastening mechanism in accordance with claim 8, wherein the displacement movement of the actuating element (36) is limited in two displacement directions by detents, and a compression spring (33) displaces the locking lever (32) in a direction of the closed position when the actuating element (36) is released.

16. In the fastening mechanism in accordance with claim 8, wherein the locking lever (32) and the locking claw (42) are rotatably seated on a mounting element (30) attached to the inside of the cover (10), and the hinge pins (31, 41) are aligned parallel with respect to each other and the link pin (15) of the cover (10).

17. In the fastening mechanism in accordance with claim 8, wherein in the open position of the fastening mechanism the locking claw (42) is restored to and maintained in the receiving position for the locking bolt (23).

18. In the fastening mechanism in accordance with claim 8, wherein the locking lever (32) and the mounting element (30) are embodied as a one-piece plastic element.

19. In the fastening mechanism in accordance with claim 8, wherein in the receiving position the locking claw (42) is snapped into a snap- in receiver (46) of the mounting element (30) by a snap-in projection (46), and while closing and releasing the fastening mechanism the snapped-in connection is achieved and released by rotating the locking claw (42).

* * * * *